United States Patent [19]

Wetzel et al.

[11] Patent Number: 4,549,490

[45] Date of Patent: Oct. 29, 1985

[54] FURNACE CONSTRUCTION

[76] Inventors: Clifford C. Wetzel, Rte. 2; Gerald L. Wetzel, 1080 S. Croswell Rd.; James C. Wetzel, Rte. 2, all of, Ithaca, Mich. 48847

[21] Appl. No.: 633,846

[22] Filed: Jul. 24, 1984

[51] Int. Cl.[4] ..... F23K 3/00

[52] U.S. Cl. ..... 110/101 R; 110/102; 110/118; 414/306

[58] Field of Search ..... 110/101, 102, 105, 108, 110/118, 256, 293, 115; 414/306, 307

[56] References Cited

U.S. PATENT DOCUMENTS

| | | | |
|---|---|---|---|
| 1,806,916 | 5/1931 | Requa | 110/293 |
| 3,865,053 | 2/1975 | Kolze et al. | 110/102 X |
| 4,270,464 | 6/1981 | Kerres | 110/102 |
| 4,311,102 | 1/1982 | Kolze et al. | 110/102 X |
| 4,484,530 | 11/1984 | Goetzman | 110/118 |

FOREIGN PATENT DOCUMENTS

| | | | |
|---|---|---|---|
| 2448798 | 4/1975 | Fed. Rep. of Germany | 414/306 |

*Primary Examiner*—Edward G. Favors

*Attorney, Agent, or Firm*—Learman & McCulloch

[57] ABSTRACT

A furnace having a fuel hopper in communication with a combustion chamber provided with an inclined, fuel-supporting grate. A rotary, flexible feed arm composed of a helically coiled wire serves to feed fuel from the hopper on to the grate. A draft is induced through the combustion chamber and passes through the grate and fuel supported thereon.

14 Claims, 7 Drawing Figures

FURNACE CONSTRUCTION

BACKGROUND OF THE INVENTION

This invention relates to a furnace and more particularly to a furnace that is especially adapted for the combustion of fuels such as sawdust, wood chips, wood shavings, corn stalks, corn cobs, and other waste products, as well as grain, cubed artichokes, and the like.

In many rural areas of the country there is an abundance of combustible materials which could be used for fuel for the heating of residences, shops, barns, and the like. For example, many of the materials referred to above, such as corn, have excellent latent heat properties and cost considerably less per energy unit than does natural gas or fuel oil. Further, under properly controlled conditions such materials burn almost completely with very little, if any, atmospheric pollution and leave a relatively low ash residue.

The principal difficulties encountered in the utilization of such materials as fuel are in the provision of proper feeding of the fuel to a combustion zone and maintaining control over the quantity and direction of air flow through the combustion zone and through the fuel itself to ensure proper combustion of the fuel.

SUMMARY OF THE INVENTION

Apparatus constructed in accordance with the invention is especially adapted for the combustion of particulate materials of the kind referred to above and includes a fuel hopper for the storage of fuel. The hopper is in communication with a combustion zone to which fuel is delivered under the control of a feed member such as a sweep or scraper which ensures an adequate supply of fuel at all times to the combustion zone.

In the combustion zone is a grate onto which the fuel may be delivered and which is so constructed and oriented as to provide a bed of combustible material in the combustion zone. The grate has a plurality of air passages therein through which air may pass into and through the bed of fuel so as to ensure even and virtually complete combustion of the fuel.

The flow of combustion air into and through the combustion zone is regulated by a conventional, thermostatically controlled draft inducer and damper. The products of combustion are discharged from the combustion zone to a heat exchanger and thence to a flue.

A thermostatically controlled blower associated with the heat exchanger provides for the distribution of heated air from the heat exchanger to an area that is to be heated.

DESCRIPTION OF THE DRAWINGS

A preferred embodiment of the invention is disclosed in the following description and illustrated in the accompanying drawings, wherein.

THE PREFERRED EMBODIMENT

Figure 1:
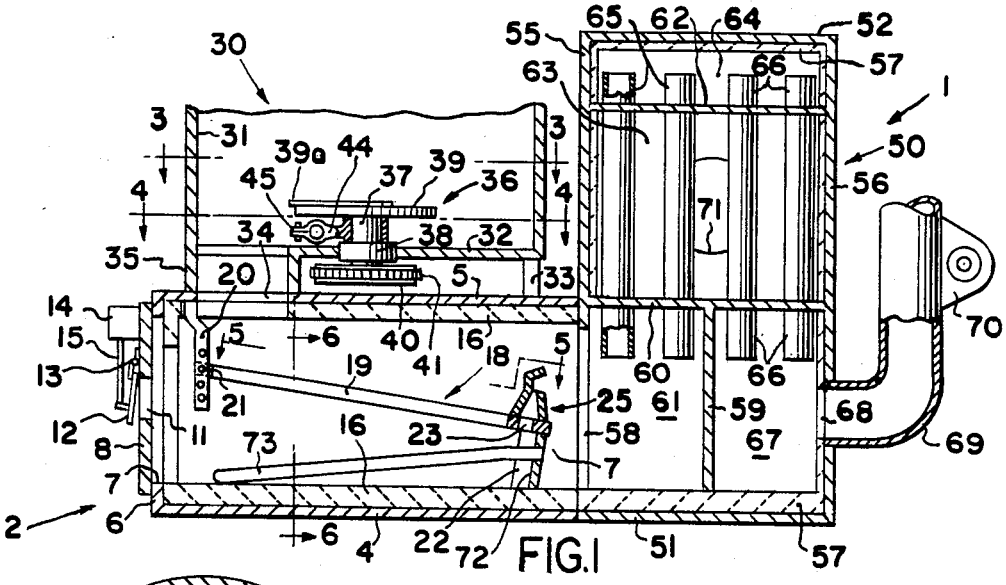
FIG. 1 is a vertical sectional view through a furnace constructed in accordance with the invention.

A furnace constructed in accordance with the presently preferred embodiment of the invention is indicated generally by the reference character 1 and comprises a base 2 having spaced, parallel side walls 3, a bottom wall 4, and a top wall 5. At one end of the base unit 2 is a front wall 6 provided with an opening 7 which normally is closed by a door 8 that is hinged at 9 to the front wall 6. A conventional latch (not shown) and operating handle 10 enable the door to be latched in its closed position or swung to an open position. The door 8 has a draft opening 11 therein which normally is maintained closed by a damper 12 that is hinged at 13 to the door. A solenoid 14 has it armature 15 pivotally connected to the damper 12 so as to open and close the latter when energized and deenergized, respectively. The inner surfaces of the base 2 are lined by suitable refractory material 16, as is conventional.

Figure 6:
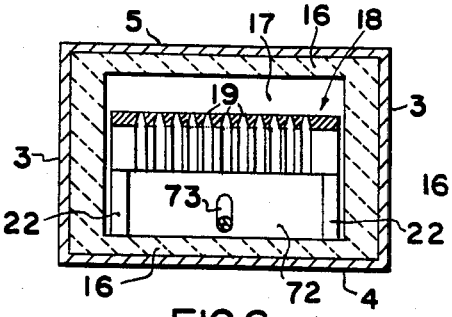
FIG. 6 is a sectional view taken along the line 6—6 of FIG. 1.
Figure 7:
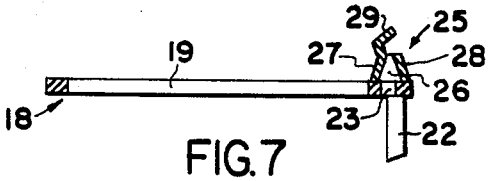
FIG. 7 is a sectional view taken along the line 7—7 of FIG. 5.

That end of the base 2 which is opposite the front wall 6 is open. Between the opposite ends of the base 2 is a combustion zone or chamber 17. Positioned in the combustion chamber is a grate 18 comprising a unitary, metallic member having slots 19 which preferably taper upwardly, as is best shown in FIG. 6.

At one of the top wall 5 of the base 2 is fixed a depending mounting strap 20 having a plurality of vertically spaced openings therein. The strap extends through a slot in the grate 18 and the latter is supported on the strap by means of a pin 21 that extends through a selected one of the openings in the strap. At the opposite end of the grate 18 is a pair of transversely spaced supporting feet 22. Between the feet 22 and the grate is provided with a pair of transversely extending passages 23. At each side of the grate, adjacent the opposite ends of the passages 23, is a pair of upstanding pins 24. Fitted over the pins 24 is a hollow duct 25 having end walls 26 and upwardly converging side walls 27 and 28, but no bottom or top walls. The duct 25 overlies the passages 23. The wall 27 has an extension 29 which projects above the wall 28 and is inclined so as to overlie the upper end of the latter.

As is shown clearly in FIG. 1, when the grate 18 is installed in the combustion chamber 17, the grate is inclined downwardly from the front wall 6 toward the opposite end of the combustion chamber with the feet 22 resting on the upper surface of the refractory lining 16. The inclination of the grate 18 preferably is between about 5 degrees and 10 degrees to the horizontal, but such inclination may vary. The width of the grate corresponds substantially to the width of the combustion chamber 17, whereas the length of the grate, while less than that of the combustion chamber, extends from closely adjacent the front wall 6 most of the length of the combustion chamber.

When the feet 22 rest on the bottom of the combustion zone, a space exists between the feet and between the grate and the bottom of the combustion zone. This space normally is closed by means and for a purpose to be described hereinafter.

A cylindrical fuel storage compartment or hopper 30 is provided and comprises a wall 31 extending upwardly from the periphery of a flat bottom 32. The hopper is supported atop the upper wall 5 of the base 2 by suitable supporting legs 33. The hopper 30 has a suitable cover (not shown). The bottom 32 has an opening 34 adjacent the wall 31. A chute 35 provides communication between the hopper 30 and the combustion zone 17 adjacent the closed end of the base 2 and adjacent the uppermost end of the grate 18. The hopper 30 is adapted to contain fuel that may be dispensed to the combustion chamber 17 via the opening 34 and the chute 35.

Fuel feeding means 36 comprises a rotary shaft 37 journaled in suitable bearings 38 carried by the hopper's bottom wall 32. At the upper end of the shaft is fixed a disc 39 having a radius corresponding to the distance from the center of the bottom wall 32 to the radially inner edge of the opening 34. Atop the disc 39 is fixed a spiralling rod 39*a* having a free end which protrudes a short distance beyond the periphery of the disc. The rod agitates fuel in the hopper and prevents its caking and bridging.

At the lower end of the shaft 34 is a fixed sprocket wheel 40 that lies in the space between the upper wall 5 of the base 2 and the bottom wall 32 of the hopper. Trained around the wheel 40 is a drive chain 41 which also is trained around a sprocket gear 42 that is driven by an electric motor 43.

As is best shown in FIG. 1, the disc 39 is vertically spaced from the bottom wall 32 of the hopper. Fixed to the shaft 37 in the space between the disc 39 and the bottom 32 is a clamp 44 having a mounting arm 45 that extends radially from the shaft 37 and is fixed to one end of an elongate fuel feed arm or scraper 46. The feed arm preferably comprises a helical spring formed of wire and having adjacent convolutions 47 of equal size spaced from one another a distance corresponding to or slightly greater than the diameter of the wire from which the feed arm is formed. That is, if the wire from which each convolution 47 is formed is $\frac{3}{8}$ inch in diameter, the spacing between adjacent convolutions may be $\frac{1}{4}$ inch. The purpose of this construction will be explained hereinafter.

Figure 4:
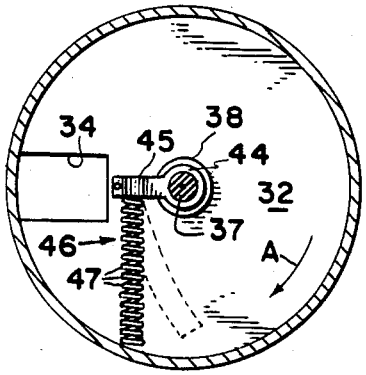
FIG. 4 is a sectional view taken along the line 4—4 of FIG. 1.
Figure 5:
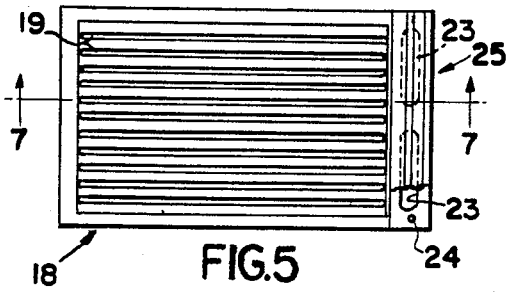
FIG. 5 is a plan view taken along the line 5—5 of FIG. 1.

The length of the feed arm 46 is such that its free end lies closely adjacent the inner surface of the hopper wall 31 when it is in its unstressed, non-flexed condition shown in full lines in FIG. 4. Since the feed arm 46 is mounted to one side of the axis of rotation of the shaft 37, however, the effective length of the arm 46 from its connection to the shaft 37 to its free end is less than the radius of the bottom wall 32 of the hopper. See FIG. 4. The purpose of this construction also will be explained hereinafter.

The open end of the base 2 is secured in any suitable way to a heat exchanger 50 having a bottom wall 51, a top wall 52, side walls 53 and 54 and front and rear walls 55 and 56. The insides of the several walls are provided with suitable refractory linings 57, as is conventional.

At its juncture with the open end of the base 2 the heat exchanger 50 has an opening 58 which provides communication between the combustion chamber 17 and the adjacent end of the heat exchanger. A vertical partition 59 and a horizontal partition 60 form an inlet chamber 61 in the heat exchanger into which gases may flow from the combustion chamber. The heat exchanger 50 also is provided with a second horizontal partition 62 which is vertically spaced above the partition 60 and divides the upper end of the heat exchanger into two chambers 63 and 64. Secured to the partitions 60 and 62 and spanning the chamber 63 is a number of open end ducts 65. Similar ducts 66 are secured to the partitions 60 and 62 and span the chamber 63 so as to provide communication between the upper chamber 64 and a lower, outlet chamber 67 that is rearward of the vertical partition 59 and below the horizontal partition 60. This chamber 67 communicates via an opening 68 with one end of a flue pipe 69 which communicates with a chimney or atmosphere.

Installed in the flue pipe 69 is a motor driven draft inducer 70 of conventional construction. Installed in communication with the chamber 63 is a duct 71 in which is located a blower (not shown) by means of which hot air from the chamber 63 may be delivered by ducts to areas to be heated. The opposite side of the chamber 63 is provided with a return air duct (not shown) as is conventional.

Figure 3:
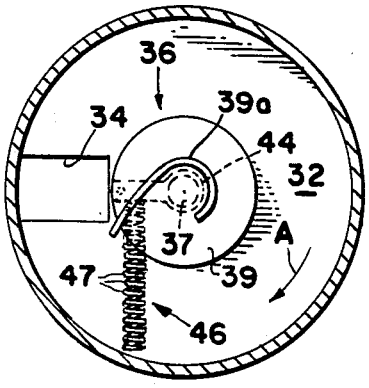
FIG. 3 is a sectional view taken along the line 3—3 of FIG. 1.
Figure 2:
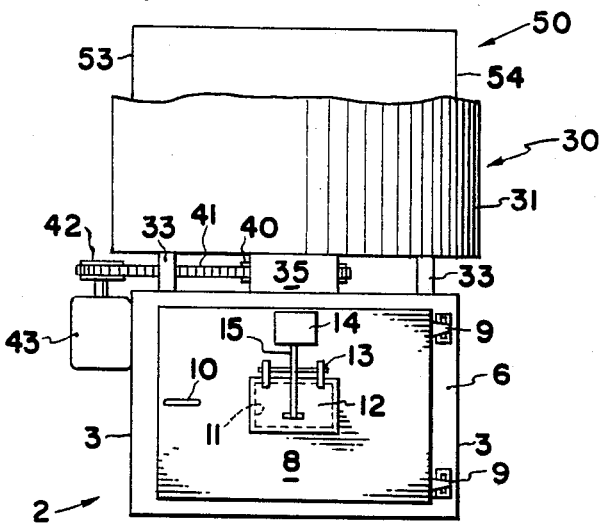
FIG. 2 is a front elevational view of the furnace.

In operation, fuel is introduced to the hopper 30 via its upper end. The motor 43 then is operated to cause rotation of the shaft 37 and the feed arm 46 in the direction of the arrow A shown in FIGS. 3 and 4. Preferably, the driving motor includes a suitable speed reduction mechanism so that the rate of rotation of the feed arm 46 is between about two and five revolutions per minute. As the feed arm rotates, it will pass under the fuel contained in a hopper and push a portion thereof toward the opening 34 for discharge through the chute 5 onto the grate 18. Fuel discharged onto the grate 18 may be ignited and will work its way toward the lower end of the grate as a result of the inclination of the latter.

The motor driven draft inducer 70 is controlled by a conventional thermostat (not shown) which, when the ambient temperature reaches a predetermined low level, energizes the draft inducer to cause the latter to commence operation. At the same time, the thermostat also causes the solenoid 14 to be energized so as to open the damper 12. Combustion air thus is drawn into the combustion chamber 17 at a level below that of the grate 18.

A combined rake and air block is provided and includes a blade 72 of such size as to occupy the space between the lower end of the grate 18 and the bottom of the combustion chamber 17 and to span the distance between the grate feet 22. A handle 73 that is fixed to the blade 72 enables the latter to be moved to a blocking position as shown in FIGS. 1 and 6 in which little, if any, air passes beneath the lower end of the grate.

Under the draft induced by the draft inducer 70, air will pass through the slots 19 of the grate 18 and through the bed of burning fuel, and thence into the chamber 61, through the tubes 65 to the chamber 64, and from the chamber 64 through the tubes 66 to the chamber 67 and finally into the flue pipe 69. In addition, air may enter the duct 25 via the opening 23 for discharge directly into the chamber 61, thereby providing ample secondary air for the combustion of unburned fuel particles which may find their way into the heat exchanger.

A thermostatically controlled switch (not shown) associated with the blower located in the duct 71 will be actuated in response to a predetermined rise in temperature of the air in the chamber 65 so as to energize the blower and cause heated air to flow from the chamber 65 to areas that are to be treated.

Following an increase in the ambient temperature to a predetermined level, the thermostat which controls the draft inducer 70 and the solenoid 14 will operate to deenergize the latter and terminate operation of the inducer. The damper 12 thus will be closed. When the temperature of air in the chamber 63 cools sufficiently, the blower in the duct 71 will stop.

The offsetting of the feed arm 46 to one side of the axis of rotation of the shaft 37 enables two significant advantages to be achieved. First, any obstruction to rotation of the arm 46 will cause the free end of the arm to be deflected rearwardly, as is shown in dotted lines in FIG. 4. Such deflection will cause the free end of the arm 46 to move away from the hopper wall 31, rather than toward the latter. As a consequence, such deflection of the arm cannot cause jamming between the free end of the arm and the side wall of the hopper.

A second advantage to offsetting the arm 46 to one side of its axis of rotation is that rotary movement of the arm causes fuel on the bottom of the hopper to be moved not only clockwise toward the opening 34, but also radially outwardly toward the wall of the hopper. Consequently, fuel may not collect at the center region of the hopper bottom.

The spacing apart of adjacent convolutions 47 of the arm 46 a distance corresponding to or greater than the diameter of the coiled wire minimizes any possibility that fuel particles may bridge the space between adjacent convolutions. Thus, the possibility of packing the space between adjacent convolutions and stiffening the member 46 is remote. Another advantage in the spacing between the adjacent convolutions is that such spacing virtually ensures flexibility of the arm so as to enable the latter to deflect in the event it encounters some obstruction to its free rotation.

The disclosed embodiment is representative of a presently preferred form of the invention but is intended to be illustrative of the invention rather than definitive thereof. The invention is defined in the claims.

I claim:

1. A furnace construction comprising a housing having a storage compartment for the accommodation of particulate fuel and a combustion chamber beneath said storage compartment, said housing having an upstanding side wall and a bottom, said bottom having an opening therein through which fuel may pass into said combustion chamber; an elongate fuel feed member; means mounting said feed member within said storage compartment for movement in a rotary path about an axis, said feed member being offset transversely from said axis and extending from adjacent said axis toward said side wall and adjacent said bottom, said feed member being of such length as to span said opening; and driving means for driving said feed member along said path.

2. Apparatus according to claim 1 wherein said opening is adjacent said side wall.

3. Apparatus according to claim 1 wherein said feed member is yieldable and capable of flexing between its ends.

4. Apparatus according to claim 1 wherein said feed member comprises a coiled spring.

5. Apparatus according to claim 4 wherein adjacent convolutions of said spring are spaced from one another.

6. Apparatus according to claim 1 wherein said feed member is offset from said axis in such direction that movement of said feed member along said path in one direction urges fuel toward said side wall.

7. Apparatus according to claim 1 including a disc overlying said bottom and said feed member, said disc having an area less than that of said bottom, thereby enabling fuel to pass by said disc and reach said bottom.

8. Apparatus according to claim 7 including means carried by said disc for agitating fuel in said storage compartment.

9. Apparatus according to claim 7 wherein said opening extends radially inwardly from adjacent said side wall.

10. Apparatus according to claim 1 wherein one end of said feed member terminates proximate said side wall and its other end terminates well short of said wall.

11. Apparatus according to claim 1 including a grate, means mounting said grate in said combustion chamber and beneath said opening for receiving fuel from said opening, said grate being inclined downwardly in a direction away from said opening.

12. Apparatus according to claim 11 wherein said grate has openings therein through which combustion air may pass.

13. Apparatus according to claim 11 including draft inducing means for inducing air to flow through said grate in a direction from its bottom toward its top.

14. Apparatus according to claim 11 including duct means at one end of said grate forming an end wall for fuel supported on said grate and providing a passage through said grate beyond said fuel bed through which air may pass.

* * * * *